US010086600B2

(12) United States Patent
Mantani et al.

(10) Patent No.: US 10,086,600 B2
(45) Date of Patent: Oct. 2, 2018

(54) SCREEN PRINTING APPARATUS AND SCREEN PRINTING METHOD

(71) Applicant: Panasonic Intellectual Property Management Co., Ltd., Osaka (JP)

(72) Inventors: Masayuki Mantani, Saga (JP); Takaaki Sakaue, Yamanashi (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 15/643,220

(22) Filed: Jul. 6, 2017

(65) Prior Publication Data

US 2018/0065357 A1 Mar. 8, 2018

(30) Foreign Application Priority Data

Sep. 7, 2016 (JP) ..... 2016-174221

(51) Int. Cl.

| | |
|---|---|
| ***B41F 33/00*** | (2006.01) |
| ***B41F 15/34*** | (2006.01) |
| ***B41F 15/08*** | (2006.01) |
| ***B41F 15/14*** | (2006.01) |
| ***B41F 15/12*** | (2006.01) |

(Continued)

(52) U.S. Cl.

CPC ..... *B41F 15/34* (2013.01); *B41F 15/08* (2013.01); *B41F 15/0881* (2013.01); *B41F 15/12* (2013.01); *B41F 15/14* (2013.01); *B41F 15/36* (2013.01); *B41F 33/00* (2013.01); *B41F 33/16* (2013.01)

(58) Field of Classification Search

CPC ..... B41F 15/08; B41F 15/0881; B41F 15/12; B41F 15/14; B41F 15/34; B41F 15/36; B41F 33/00; B41F 33/16

See application file for complete search history.

(56) References Cited

U.S. PATENT DOCUMENTS 5,906,158 A * 5/1999 Takai ..... B41F 15/0818 101/123
5,970,867 A * 10/1999 Barozzi ..... B41F 15/10 101/126

(Continued)

FOREIGN PATENT DOCUMENTS

JP 2861332 B2 2/1999

*Primary Examiner* — Leslie J Evanisko
*Assistant Examiner* — Marissa Ferguson Samreth
(74) *Attorney, Agent, or Firm* — Pearne & Gordon LLP

(57) ABSTRACT

A screen printing apparatus moves a mask, inserted through an insertion opening, to a printing position at which paste is printed onto a substrate via a mask moving mechanism, and includes: a first detecting unit that detects one of a front frame component and a back frame component of the mask at a first detection position on a path along which the mask inserted through the insertion opening is moved to the printing position; a second detecting unit that detects one of the front frame component and the back frame component at a second detection position closer to the printing position than the first detecting position is; and a print suspension controller that suspends printing when the second detecting unit detects one of the front frame component and the back frame component while the first detecting unit is detecting one of the front frame component and the back frame component.

7 Claims, 13 Drawing Sheets

(51) Int. Cl.
*B41F 33/16* (2006.01)
*B41F 15/36* (2006.01)

(56) References Cited

U.S. PATENT DOCUMENTS

| | | | | |
|---|---|---|---|---|
| 9,044,929 | B2 * | 6/2015 | Sato | B41F 15/0881 |
| 9,398,696 | B2 * | 7/2016 | Miyake | B41F 15/08 |
| 2013/0192481 | A1 * | 8/2013 | Abe | B41F 15/0881<br>101/123 |
| 2014/0116275 | A1 * | 5/2014 | Walker | B41J 11/002<br>101/424.1 |

* cited by examiner

SCREEN PRINTING APPARATUS AND SCREEN PRINTING METHOD

BACKGROUND

1. Technical Field

The present disclosure relates to a screen printing apparatus that prints paste onto a substrate using a mask having holes.

2. Description of the Related Art

A screen printing apparatus prints paste onto a substrate by bringing a mask having holes into contact with the substrate and filling the holes with paste using a print head. Different masks are prepared for different types of substrates to be manufactured. When a set-up change is made—that is to say, when the type of substrate to be manufactured is changed—the mask in the screen printing apparatus is exchanged for a different mask that corresponds to the next type of substrate to be manufactured. A screen printing apparatus is known that automatically exchanges the masks (for example, see Japanese Patent No. 2861332).

The screen printing apparatus according to Japanese Patent No. 2861332 includes a stocker that stores a plurality of masks, and automatically exchanges masks upon a set-up change by removing the mask corresponding to the next type of substrate to be manufactured from the stocker via a conveyer belt and catching a slider on the frame of the removed mask and moving the slider to set the next mask to be used at a predetermined position.

SUMMARY

Although the screen printing apparatus according to Japanese Patent No. 2861332 is capable of storing a plurality of masks, the screen printing apparatus is complicated and large as a result of including a stocker and an apparatus for removing the masks from the stocker. However, there is also a demand for a screen printing apparatus that can merely store the next mask to be used. In such cases, an insertion opening for inserting masks is provided in a cover on one end of the screen printing apparatus, and the next mask is inserted through the insertion opening and kept in standby until it is time to exchange the masks. However, for the safety of the operator, it is necessary to suspend the printing before inserting the next mask into the insertion opening, which is problematic in that it reduces productivity.

In light of this, the present disclosure has an object to provide a screen printing apparatus and screen printing method that enables productive and safe exchanging of masks.

A screen printing apparatus according to one aspect of the present disclosure moves a mask, inserted through an insertion opening, to a printing position at which paste is printed onto a substrate via a mask moving mechanism. The screen printing apparatus includes: a first detecting unit configured to detect presence or absence of a front frame component of the mask and a back frame component of the mask at a first detection position on a path along which the mask inserted through the insertion opening is moved to the printing position; a second detecting unit configured to detect presence or absence of the front frame component and the back frame component of the mask at a second detection position closer to the printing position than the first detection position is; and a print suspension controller that suspends printing when a detection result of the second detecting unit is presence while a detection result of the first detecting unit is presence.

A screen printing method according to one aspect of the present disclosure is a method of moving a mask, inserted through an insertion opening, to a printing position at which paste is printed onto a substrate via a mask moving mechanism. The method includes: a first detection step for detecting presence or absence of a front frame component of the mask and a back frame component of the mask at a first detection position on a path along which the mask inserted through the insertion opening is moved to the printing position; a second detection step for detecting presence or absence of the front frame component and the back frame component of the mask at a second detection position closer to the printing position than the first detection position is; and a print suspension control step for suspending printing when a detection result is presence in the second detection step while a detection result is presence in the first detection step.

According to the present disclosure, masks can be productively and a safely exchanged.

BRIEF DESCRIPTION OF DRAWINGS

These and other objects, advantages and features of the disclosure will become apparent from the following description thereof taken in conjunction with the accompanying drawings that illustrate a specific embodiment of the present disclosure.

DETAILED DESCRIPTION OF THE EMBODIMENT

Figure 1:
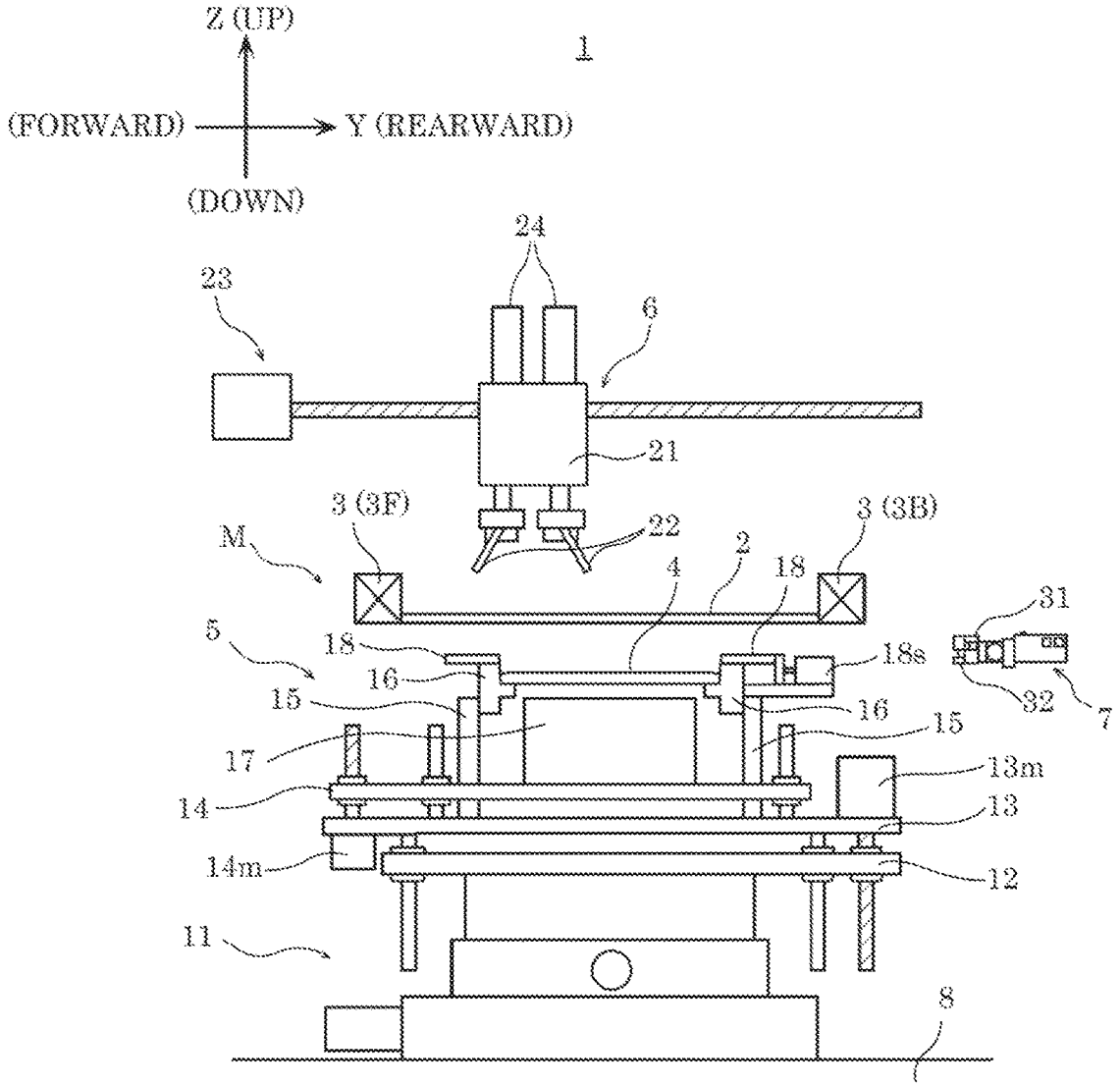
FIG. 1 is a side view illustrating the structure of a screen printing apparatus according to one embodiment of the present disclosure.

Hereinafter, an embodiment of the present disclosure will be described in detail with reference to the drawings. The following configurations, shapes, etc., described below are merely examples, and may be appropriately modified according to the application of the screen printing apparatus. In the drawings, like elements share like reference signs. As such, duplicate description of the same elements will be omitted in the following description. In the following description, a line along which the substrate is transported is defined as the X line (extending left and right in FIG. 2), a line along which the mask is transported is defined as the Y line (extending left and right in FIG. 1 and up and down in FIG. 2), which is perpendicular to the X line in a horizontal plane, and a vertical line perpendicular to the horizontal plane is defined as the Z line (extending up and down in FIG. 1). Note that hereinafter, "forward", "rearward", "left", and "right" are defined relative to the direction of travel of the mask. More specifically, "forward" refers to the direction in which the mask travels, and corresponds to the negative direction along the Y axis. "Rearward" refers to the direction opposite the direction in which the mask travels, and corresponds to the positive direction along the Y axis. "Left" refers to left from the front looking rearward, and corresponds to the negative direction along the X axis. "Right" refers to right from the perspective of the direction in which the mask travels, and corresponds to the positive direction along the X axis.

Figure 2:
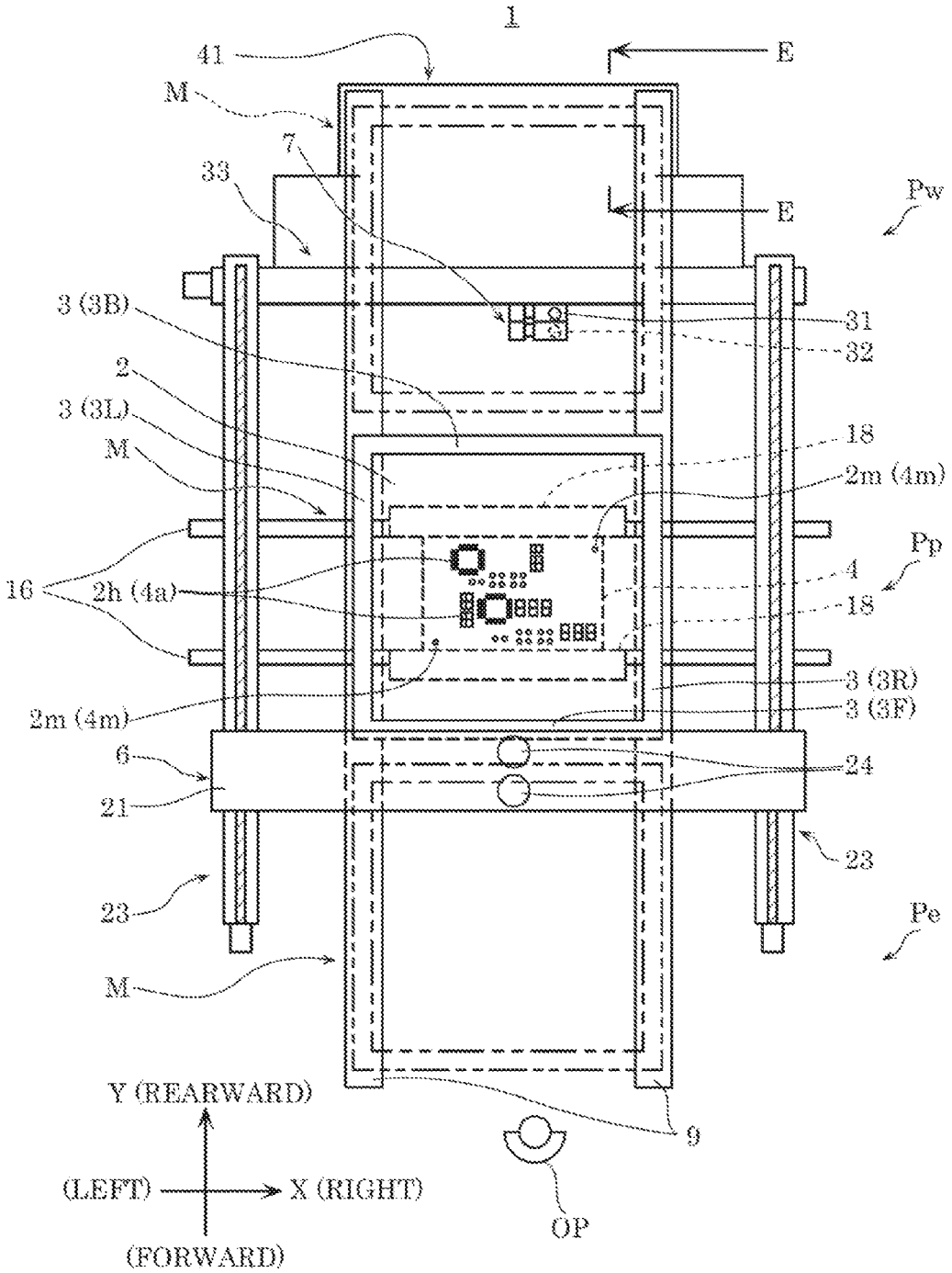
FIG. 2 is a plan view illustrating the structure of a screen printing apparatus according to one embodiment of the present disclosure.

First, the structure of screen printing apparatus 1 will be described with reference to FIG. 1 through FIG. 3. In FIG. 1 and FIG. 2, screen printing apparatus 1 is an apparatus that prints paste, such as solder paste, onto substrate 4 through mask M including frame 3 and screen 2 which has holes 2*h* and is stretched across frame 3. Screen printing apparatus 1 includes substrate retaining and moving unit 5, squeegee unit 6, camera unit 7, and a paste feed apparatus (not illustrated in the drawings). Hereinafter, when differentiation is necessary, in a state in which mask M is arranged in screen printing apparatus 1, the component of frame 3 in the front along the Y line is referred to as front frame component 3F, the component of frame 3 in the rear along the Y line is referred to as back frame component 3B, the component of frame 3 on the right along the X line is referred to as right frame component 3R, and the component of frame 3 on the left along the X line is referred to as left frame component 3L.

Substrate retaining and moving unit 5 is disposed above base 8, and retains and moves substrate 4. Right frame component 3R and left frame component 3L are supported from below by pair of mask guides 9 that extend parallel to the Y line, and mask M is held horizontally at a predetermined position in screen printing apparatus 1 Mask M is used for printing paste onto substrate 4 retained by substrate retaining and moving unit 5. Mask M is retained at printing position Pp at which paste is printed on substrate 4 above substrate retaining and moving unit 5. Squeegee unit 6 is disposed above mask M. Camera unit 7 is disposed below mask M. The paste feed apparatus is integral with squeegee unit 6, and feeds paste onto screen 2 of mask M retained at printing position Pp.

Next, each element included in screen printing apparatus 1 will be described sequentially in detail. In FIG. 1, substrate retaining and moving unit 5 includes, on base 8, in order from the bottom to the top, XYθ moving mechanism 11, base table 12, first elevation table 13, and second elevation table 14. Base table 12 moves in a horizontal plane and rotates θ degrees about the Z axis via XYθ moving mechanism 11. First elevation table 13 moves up and down relative to base table 12 via first elevation table elevation motor 13*m*. Second elevation table 14 moves up and down relative to first elevation table 13 via second elevation table elevation motor 14*m*.

Pair of conveyor support components 15 that extend upward through second elevation table 14 are provided above first elevation table 13. Pair of conveyor support components 15 support pair of transport conveyors 16 that extend parallel to the X line and are aligned along the Y line. Pair of transport conveyors 16 support two ends of substrate 4 from below and transport substrate 4 along the X line. Lower support component 17 is provided on the top surface of second elevation table 14.

A pair of clamp components (clamps 18) are provided above pair of transport conveyors 16, extend parallel to the X line, and are aligned along the Y line. Pair of clamps 18 open and close along the Y line via actuation by clamp actuating cylinder 18*s*, and sandwich and retain (clamp) two ends of substrate 4 supported by lower support component 17.

In FIG. 2, holes 2*h* that correspond to electrodes 4*a* of substrate 4 are formed in screen 2 of mask M. Moreover, a group of mask marks 2*m* are marked on screen 2. The group of mask marks 2 corresponds to a group of substrate marks 4*m* marked at diagonally opposing positions on substrate 4. When substrate marks 4*m* and mask marks 2*m* are aligned in a plan view, substrate 4 is raised so as to come into contact with mask M, whereby electrodes 4*a* of substrate 4 and holes 2*h* of mask M coincide with one another.

In FIG. 1 and FIG. 2, squeegee unit 6 includes two squeegees 22 aligned along the Y line below squeegee base 21 extending parallel to the X line. Squeegee base 21 is moved along the Y line by squeegee unit moving mechanism 23. The two squeegees 22 are moved up and down individually relative to squeegee base 21 by squeegee elevation cylinder 24 disposed on squeegee base 21.

In FIG. 1 and FIG. 2, camera unit 7 includes upward imaging camera 31 pointed upward so as to have an upward imaging field of view, and downward imaging camera 32 pointed downward so as to have a downward imaging field of view. Camera unit 7 is moved in the horizontal plane by camera unit moving mechanism 33. Horizontal positioning of substrate 4 relative to mask M at printing position Pp is performed by inserting camera unit 7 between substrate 4 and mask M, imaging mask marks 2*m* using upward imaging camera 31, imaging substrate marks 4*m* using downward imaging camera 32, and performing the positioning based on the imaging results.

In FIG. 2, rearward of printing position Pp along the Y line is waiting position Pw at which a replacement mask M to be inserted through insertion opening 41 provided in the rear surface of screen printing apparatus 1 is kept on standby. Forward of the printing position Pp along the Y line is exit position Pe for moving the used mask M and removing the used mask M from the apparatus. Pair of mask guides 9 extend parallel to the Y line, and include waiting position Pw, printing position Pp, and exit position Pe. Mask M inserted through insertion opening 41 moves forward along the Y line, on pair of mask guides 9, from waiting position Pw to printing position Pp and then to exit position Pe.

Figure 3:
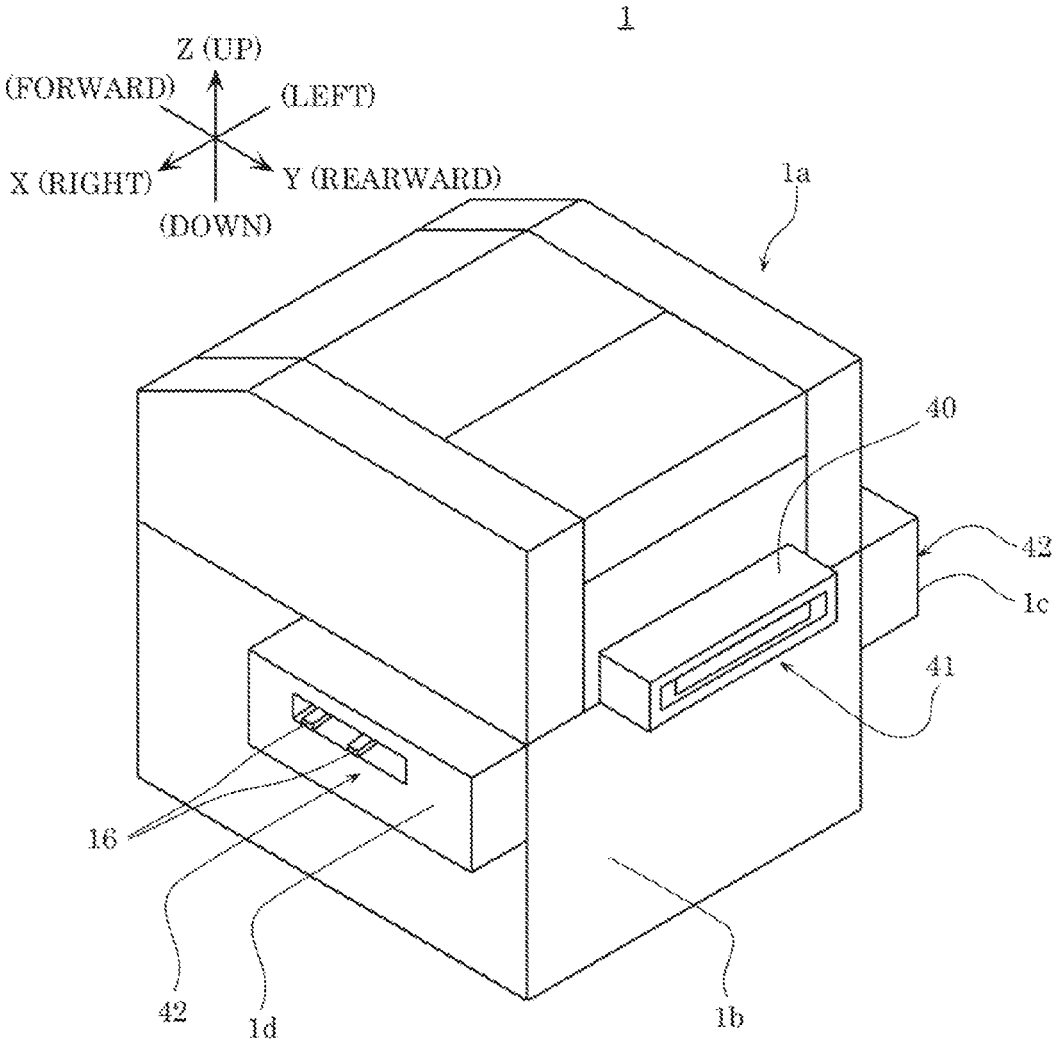
FIG. 3 is a perspective view illustrating the exterior of a screen printing apparatus according to one embodiment of the present disclosure.
Figure 4:
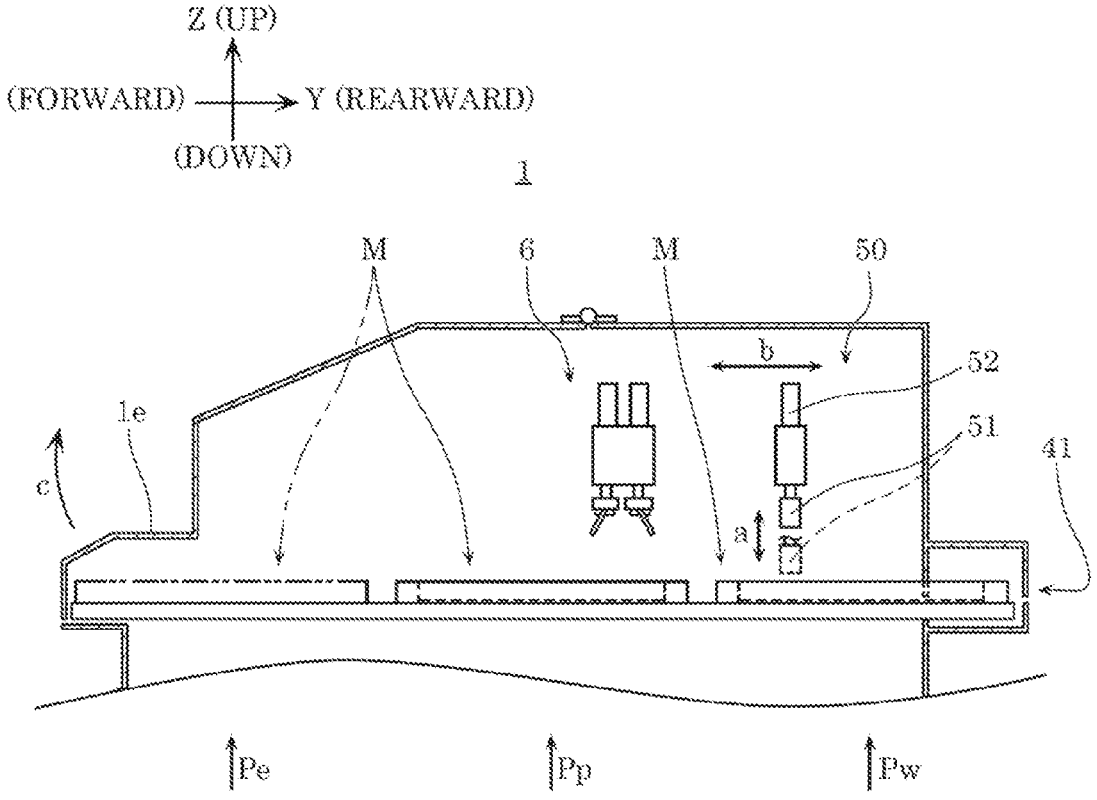
FIG. 4 is for illustrating mask positions and a mask moving mechanism in a screen printing apparatus according to one embodiment of the present disclosure.

In screen printing apparatus 1 illustrated in FIG. 3, waiting position Pw, printing position Pp, and exit position Pe are covered by enclosure 1*a*. With this, the operator is protected from being touched by moving parts. Insertion detector 40 (to be described later) is provided protruding rearward from side wall 1*b* on the rear side of enclosure 1*a*. Insertion opening 41 into which a replacement mask M is inserted is formed on the rear surface of insertion detector 40. Entrance and exit openings 42 through which substrate 4 is transported onto and off of pair of transport conveyors 16 are formed on left and right side walls 1*c* and 1*d* of enclosure 1*a*.

Next, the printing method of printing paste onto substrate 4 in screen printing apparatus 1 configured as described above will be described. The printing method described below is performed by screen printing apparatus 1. First, mask M corresponding to substrate 4 to be printed with paste is moved to and retained at printing position Pp. Next, after substrate 4 is inserted and aligned with mask M at printing position Pp, substrate 4 is lifted so as to come into contact with mask M. Next, the paste feed apparatus feeds paste onto screen 2 of mask M at printing position Pp. Next, one squeegee 22 is lowered and moved along the Y line (i.e., along a line extending forward and backward). This fills holes 2*h* of screen 2 with paste. Next, substrate 4 is lowered to separate substrate 4 from mask M, whereby the paste that filled holes 2*h* is transferred (printed) onto electrodes 4*a* on substrate 4.

Next, mask moving mechanism 50 included in screen printing apparatus 1 will be described. When changing the type of substrate 4 to be printed with paste, mask M is exchanged with mask M corresponding to the new substrate 4. This is also known as making set-up change. In screen printing apparatus 1 according to this embodiment, mask moving mechanism 50 automatically exchanges masks M upon a set-up change.

Mask moving mechanism 50 includes, at the lower end thereof, abutting component 51 that abuts frame 3 of mask M and moves mask M. Mask moving mechanism 50 includes cylinder 52 that raises and lowers abutting component 51 (arrow a). Mask moving mechanism 50 further includes an anteroposterior movement mechanism (omitted from the drawings) that moves abutting component 51 and cylinder 52 forward and backward along the Y line (arrow b). Note that the anteroposterior movement mechanism may also function as squeegee unit moving mechanism 23 that moves squeegee base 21 forward and backward along the Y line. Mask moving mechanism 50 is controlled by exchange processing unit 63 (see FIG. 12) included in control apparatus 60.

Upon making a set-up change, mask M that is inserted through insertion opening 41 and positioned at waiting position Pw is automatically moved to printing position Pp by mask moving mechanism 50 controlled by exchange processing unit 63. Moreover, after being used, mask M positioned at printing position Pp is automatically moved to exit position Pe by mask moving mechanism 50 controlled by exchange processing unit 63. Mask M moved to exit position Pe is removed after the operator upwardly opens (arrow c) cover 1*e* located on the top-front portion of enclosure 1*a* covering and protecting mask M. There is no need for the operator to synchronize the removal of the used mask M with the set-up change; the operator may remove the used mask M at any given time, such as when stopping at screen printing apparatus 1 while making his or her rounds.

Figures 5A, 5B, 5C, 5D, 5E:
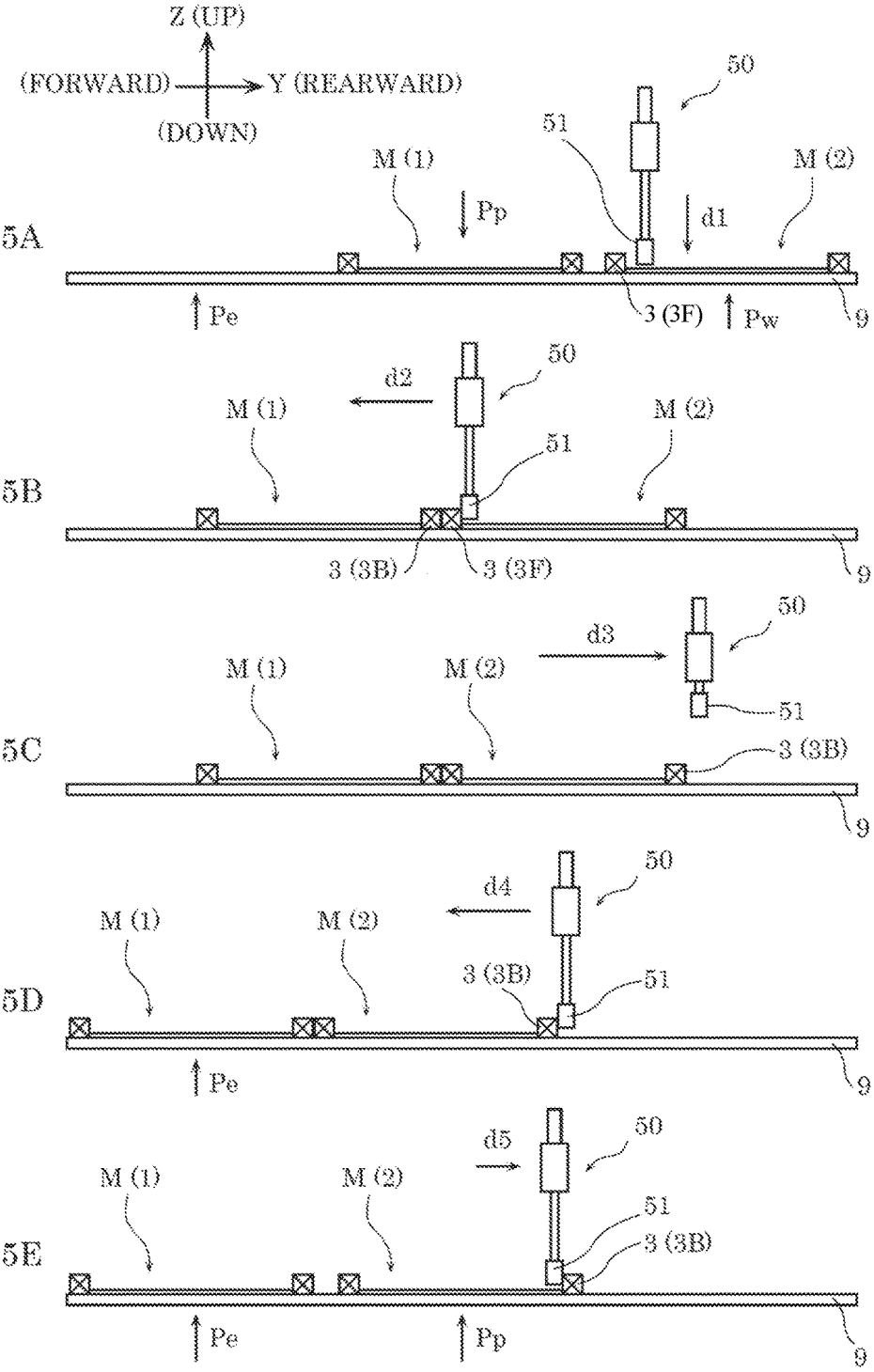
FIG. 5A is for illustrating a mask exchange step in a screen printing apparatus according to one embodiment of the present disclosure.
FIG. 5B is for illustrating a mask exchange step in a screen printing apparatus according to one embodiment of the present disclosure.
FIG. 5C is for illustrating a mask exchange step in a screen printing apparatus according to one embodiment of the present disclosure.
FIG. 5D is for illustrating a mask exchange step in a screen printing apparatus according to one embodiment of the present disclosure.
FIG. 5E is for illustrating a mask exchange step in a screen printing apparatus according to one embodiment of the present disclosure.

Next, with reference to FIG. 5A through FIG. 5E, the exchanging of masks M by mask moving mechanism 50 will be described. Upon making a set-up change, the exchanging of masks M is automatically performed under control by exchange processing unit 63. In FIG. 5A, used mask M(1) is positioned at printing position Pp, and replacement mask M(2) is positioned at waiting position Pw. In this state, exchange processing unit 63 first positions abutting component 51 of mask moving mechanism 50 behind front frame component 3F of replacement mask M(2), and lowers (arrow d1) abutting component 51 to a predetermined height at which abutting component 51 will catch on front frame component 3F.

In FIG. 5B, exchange processing unit 63 then moves abutting component 51 forward (arrow d2). With this, front frame component 3F of replacement mask M(2) pushes back frame component 3B of used mask M(1) whereby used mask M(1) and replacement mask M(2) move forward along pair of mask guides 9.

In FIG. 5C, exchange processing unit 63 then raises abutting component 51 to a predetermined height at which abutting component 51 will not catch on frame 3, and moves abutting component 51 behind back frame component 3B of replacement mask M(2) while maintaining this height (arrow d3). In FIG. 5D, exchange processing unit 63 then lowers abutting component 51 to a height at which abutting component 51 will catch on back frame component 3B, and moves abutting component 51 forward (arrow d4) until used mask M(1) is positioned at exit position Pe. In this state, replacement mask M(2) is positioned forward of printing position Pp.

In FIG. 5E, exchange processing unit 63 then raises abutting component 51 to a height at which abutting component 51 will not catch on frame 3, and moves abutting component 51 in front of back frame component 3B of replacement mask M(2) while maintaining this height. Exchange processing unit 63 then lowers abutting component 51 to a height at which abutting component 51 will catch on back frame component 3B, and moves abutting component 51 rearward (arrow d5) until replacement mask M(2) reaches printing position Pp. This completes the moving of used mask M(1) to exit position Pe and the moving of replacement mask M(2) to printing position Pp.

In this way, printing position Pp at which mask M(1), which includes frame 3 and screen 2 having holes 2*h* and stretched across frame 3, is retained and paste is printed onto substrate 4, and waiting position Pw which is behind printing position Pp and is a position at which replacement mask M(2) is kept on standby are set in screen printing apparatus 1, and mask M(2) on standby at waiting position Pw is automatically moved to printing position Pp.

Figure 6A:
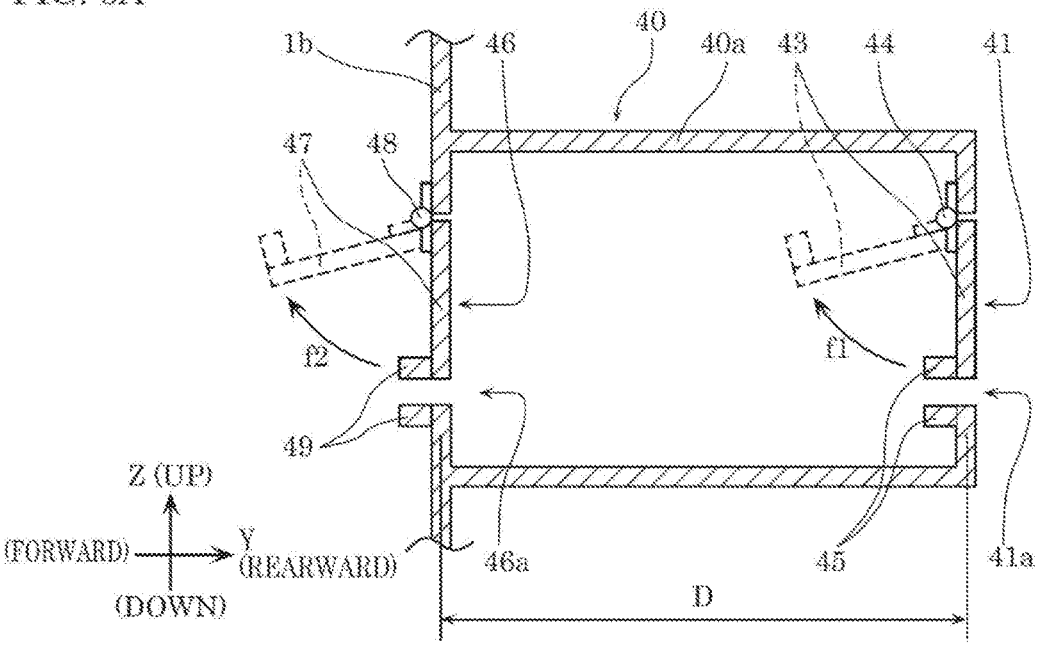
FIG. 6A is for illustrating an insertion detector included in a screen printing apparatus according to one embodiment of the present disclosure.
Figure 6B:
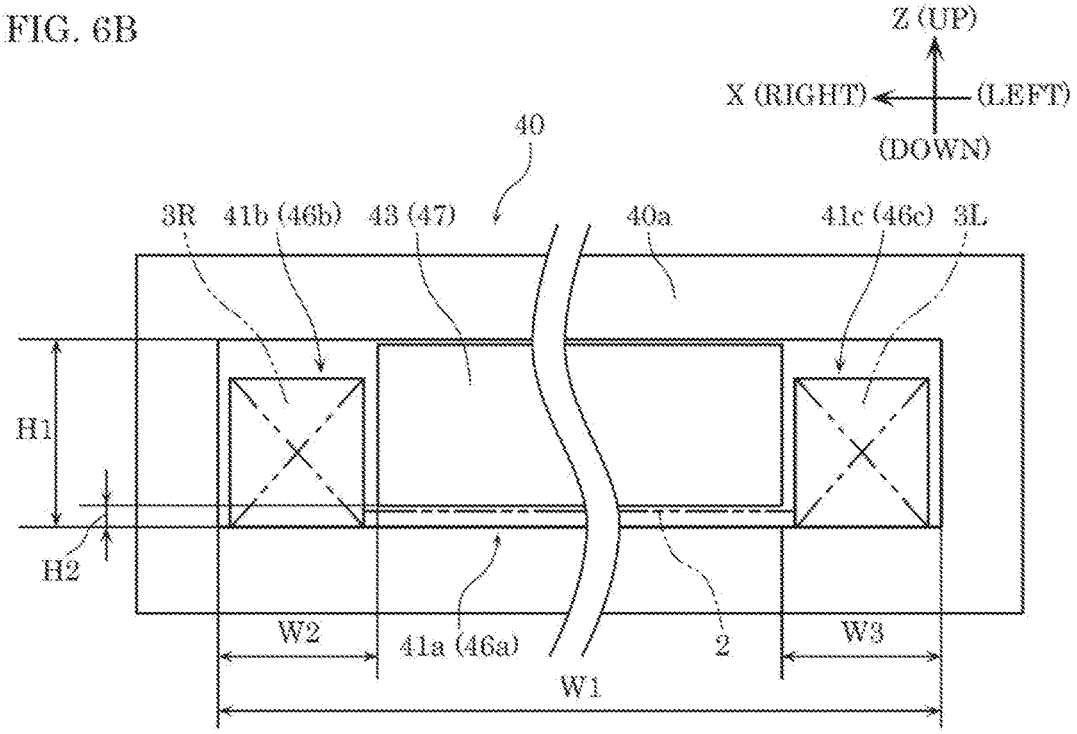
FIG. 6B is for illustrating an insertion detector included in a screen printing apparatus according to one embodiment of the present disclosure.

Next, insertion detector 40 will be described in detail with reference to FIG. 6A and FIG. 6B. FIG. 6A illustrates a cross section of insertion detector 40 taken at line EE in FIG. 2. FIG. 6B is a simplified illustration of insertion detector 40 when viewed from the back of screen printing apparatus 1, i.e., when viewed from the insertion opening 41 side. In FIG. 6B, insertion opening 41 having width W1 and height H1 is formed in the rear surface of chassis 40*a* of insertion detector 40. Width W1 and height H1 are set so as to be larger than the width and height of mask M, respectively, when mask M is laid horizontally flat. With this, while laid horizontally flat, mask M can be inserted into screen printing apparatus 1 through insertion opening 41 and positioned at waiting position Pw via insertion detector 40.

In FIG. 6A, first shutter 43 is provided at insertion opening 41. The top portion of first shutter 43 is connected to chassis 40*a* of insertion detector 40 by first hinge 44, which allows first shutter 43 to swing (arrow f1) inward into (toward the front of) screen printing apparatus 1. First shutter 43 covers insertion opening 41 while suspended vertically when no force is applied (the closed state illustrated by the solid lines in FIG. 6A). When first shutter 43 is pushed inward (forward) from the outside (rear), first shutter 43 swings inward (forward) and upward (to the open state illustrated by the dashed lines in FIG. 6A). For example, when first shutter 43 is pushed inward by front frame component 3F (this applies to back frame component 3B as well) of mask M being inserted through insertion opening 41, first shutter 43 swings forward so as to change from a closed state to an open state (see FIG. 7B).

First sensor 45, such as a proximity sensor that detects the opening and closing of first shutter 43, is disposed on the bottom end portion of first shutter 43 and across from the bottom end portion of first shutter 43 on chassis 40*a* of insertion detector 40. The detection result from first sensor 45 is transmitted to control apparatus 60 (see FIG. 12). Note that first sensor 45 is not limited to the example illustrated in FIG. 6A; first sensor 45 may be any device capable of detecting whether first shutter 43 is in an open state or in a closed state.

In this way, first shutter 43 that swings forward when pushed by the front component of frame 3 (front frame component 3F) of mask M when mask M is inserted, and first sensor 45 that detects first shutter 43 swinging forward are provided at insertion opening 41 (first detection position) through which mask M is inserted to waiting position Pw, and are a first detecting unit for detecting the presence or absence of the front component of frame 3 (front frame component 3F) of mask M, which is inserted through insertion opening 41, at the first detection position. Note that it is sufficient if the first detecting unit merely detects, at the first detection position, front frame component 3F (back frame component 3B) of mask M inserted through insertion opening 41. For example, the first detecting unit may be configured as a height sensor that detects the height of front frame component 3F (back frame component 3B).

In FIG. 6B, lower gap 41*a* having height 112 is present between the bottom of first shutter 43 and chassis 40*a* of insertion detector 40. Height H2 is set to a value greater than the thickness of screen 2 of mask M. Right gap 41*b* having width W2 is present between the right side of first shutter 43 and chassis 40*a* of insertion detector 40, and left gap 41*c* having width W3 is present between the left side of first shutter 43 and chassis 40*a* of insertion detector 40. Width W2 is set to a value greater than the width of right frame component 3R of mask M, and width W3 is set to a value greater than the width of left frame component 3L of mask M. In other words, the size and shape of first shutter 43 are set such that height 112, width W2, and width W3 fulfill the above conditions.

By providing lower gap 41*a*, right gap 41*b*, and left gap 41*c* in this manner, in a state in which front frame component 3F of mask M is inserted through insertion opening 41 to a position that does not interfere with first shutter 43 (see FIG. 8A), first shutter 43 is closed and does not interfere with screen 2, right frame component 3R, or left frame component 3L of mask M. In other words, first shutter 43 is of a size and a shape that does not interfere with left or right frame components 3 (right frame component 3R or left frame component 3L) or screen 2 of mask M when mask M is inserted. Stated differently, the first detecting unit detects objects greater than or equal to a predetermined height at the first detection position. Here, the predetermined height is less than the height of frame 3 and greater than the height of screen 2. Note that the first detection position is not limited to the position of insertion opening 41. For example, the first detection position may be a position on the path between insertion opening 41 and printing position Pp along which mask M moves, and may be a position located closer to insertion opening 41 than a second detection position is (i.e., farther from printing position Pp; the second detection position will be described later). Moreover, the first detection position is a position that front frame component 3F and back frame component 3B pass and right frame component 3R or left frame component 3L do not pass.

In FIG. 6A, middle opening 46 having width W1 and height H1 is formed at a position distance D away from insertion opening 41 toward the inside (front) of screen printing apparatus 1. Second shutter 47 is provided at middle opening 46. The top portion of second shutter 47 is connected to chassis 40*a* of insertion detector 40 by second hinge 48, which allows second shutter 47 to swing (arrow f2) inward into (toward the front of) screen printing apparatus 1, similar to first shutter 43. Second sensor 49, such as a proximity sensor that detects the opening and closing of second shutter 47, similar to first sensor 45, is positioned at the bottom end portion of second shutter 47 and at a position on chassis 40*a* of insertion detector 40 that is across from the bottom end portion of second shutter 47. The detection result from second sensor 49 is transmitted to control apparatus 60 (see FIG. 12).

In this way, second shutter 47 that swings forward when pushed by the front component of frame 3 (front frame component 3F) of mask M when mask M is inserted, and second sensor 49 that detects second shutter 47 swinging forward are provided on the printing position Pp side (i.e., in front) of the first detecting unit (first shutter 43 and first sensor 45) (i.e., provided at the second detection position), and are a second detecting unit for detecting the presence or absence of the front component of frame 3 (front frame component 3F) of mask M, which is inserted through insertion opening 41 and pushed inward, at the second detection position.

Similar to lower gap 41*a* of first shutter 43, lower gap 46*a* is present between the bottom of second shutter 47 and chassis 40*a* of insertion detector 40, so as to prevent second shutter 47 and screen 2 of mask M from interfering with each other. Similar to right gap 41*b* and left gap 41*c* of first shutter 43, right gap 46*b* and left gap 46*c* are present between the right and left sides, respectively, of second shutter 47 and chassis 40*a* of insertion detector 40, so as to prevent second shutter 47 and right frame component 3R and left frame component 3L of mask M from interfering with each other. In other words, second shutter 47 is of a size and shape that does not interfere with left or right frame components 3 (right frame component 3R or left frame component 3L) or screen 2 of mask M when mask M is inserted. Stated differently, the second detecting unit detects objects greater than or equal to a predetermined height at second detection position. Here, the second detection position is a position on the path between insertion opening 41 and printing position Pp along which mask M moves, and is positioned farther from insertion opening 41 than the first detection position is (i.e., closer to printing position Pp). Moreover, similar to the first detection position, the second detection position is a position that front frame component 3F and back frame component 3B pass and right frame component 3R or left frame component 3L do not pass.

In FIG. 6A, first hinge 44 and second hinge 48 are structured so as to not allow first shutter 43 and second shutter 47 to swing rearward (outward). In other words, first hinge 44 is a first rear stop that inhibits first shutter 43 from swinging rearward, and second hinge 48 is a second rear stop that inhibits second shutter 47 from swinging rearward. With this, mask M that is inserted through insertion opening 41 and passes the first detecting unit (first shutter 43 and first sensor 45) or the second detecting unit (second shutter 47 and second sensor 49) can be inhibited from moving outward and falling out through insertion opening 41.

In other words, the first detecting unit includes a first rear stop that inhibits first shutter 43 from swinging rearward, and the second detecting unit second includes a second rear stop that inhibits second shutter 47 from swinging rearward. Note that a stop or stops (not illustrated in the drawings) other than first hinge 44 and second hinge 48 that restrict the rearward (outward) swinging of first shutter 43 and second shutter 47 may be provided as the first rear stop and/or the second rear stop.

Next, mask insertion steps for inserting replacement mask M through insertion opening 41 will be described with reference to FIG. 7A through FIG. 9B. The mask insertion steps are performed by an operator before a set-up change. The mask insertion steps need not be synchronized with the set-up change; printing may be performed continuously at the same time as the mask insertion steps are being performed.

Moreover, while screen printing apparatus 1 is running, including while performing the mask insertion steps, the detection results of first sensor 45 and second sensor 49 are monitored by print suspension controller 62 (see FIG. 12) included in control apparatus 60. In the monitoring, whether or not anything is inserted through insertion opening 41 is monitored, and when something is inserted, the monitoring determines whether that something is mask M or a foreign object other than mask M. Hereinafter, the monitoring will be described along with the mask insertion steps.

Figure 7A:
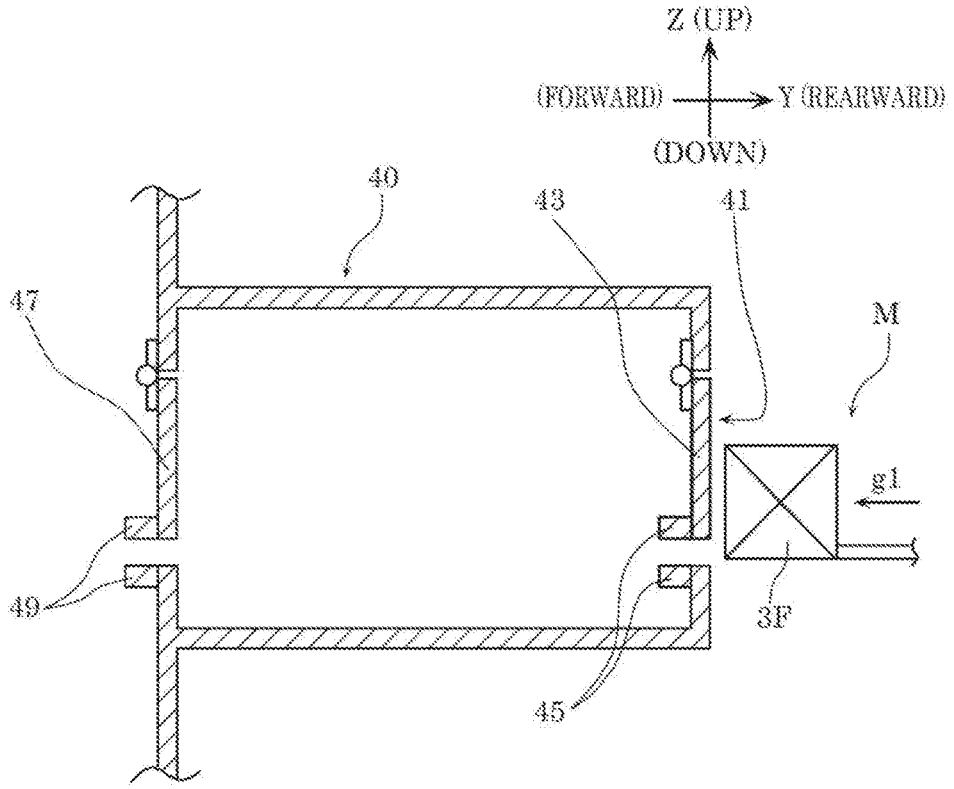
FIG. 7A is for illustrating a step of inserting a mask through an insertion opening into a screen printing apparatus according to one embodiment of the present disclosure.
Figure 7B:
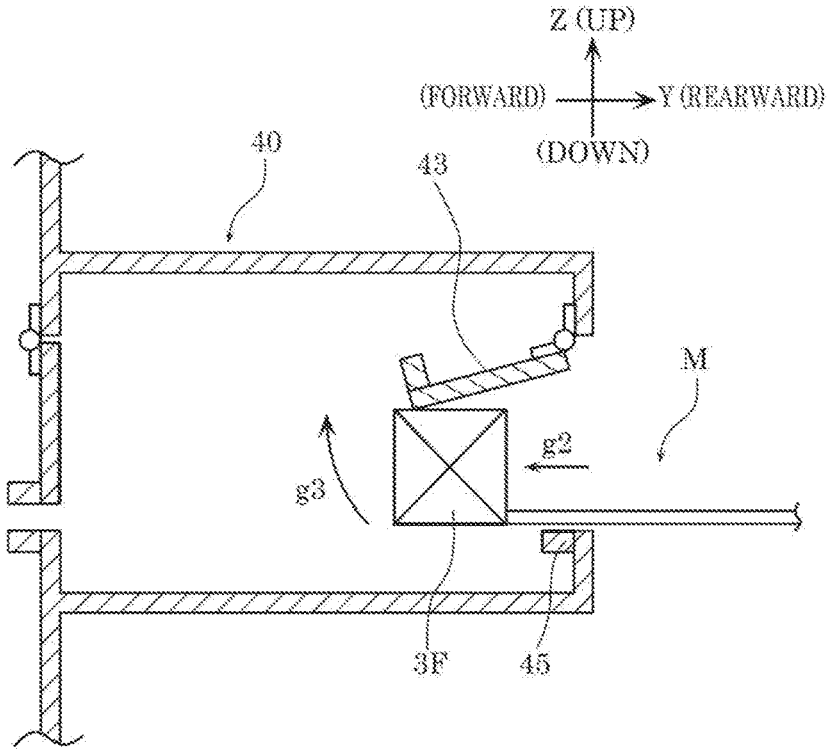
FIG. 7B is for illustrating a step of inserting a mask through an insertion opening into a screen printing apparatus according to one embodiment of the present disclosure.

In FIG. 7A, an operator is moving mask M forward from the rear, toward insertion opening 41 of insertion detector 40 (arrow g1). In this state, first sensor 45 detects a closed first shutter 43, and second sensor 49 detects a closed second shutter 47. In FIG. 7B, an operator moves mask M farther forward (inward) (arrow g2) whereby first shutter 43 is lifted upward and forward (arrow g3) by the front surface of front frame component 3F of mask M. As a result, first sensor 45 detects an open first shutter 43.

Figure 8A:
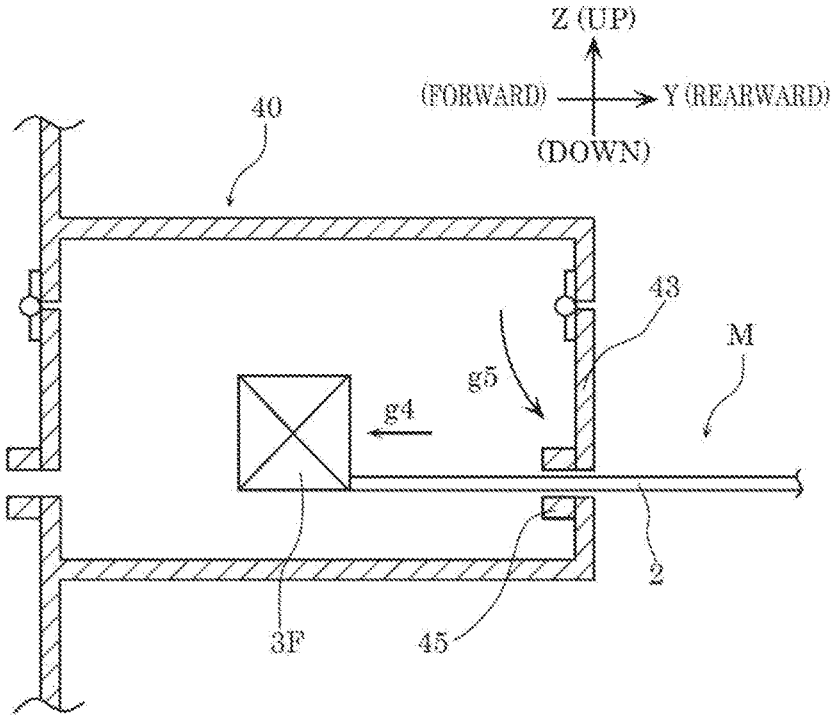
FIG. 8A is for illustrating a step of inserting a mask through an insertion opening into a screen printing apparatus according to one embodiment of the present disclosure.
Figure 8B:
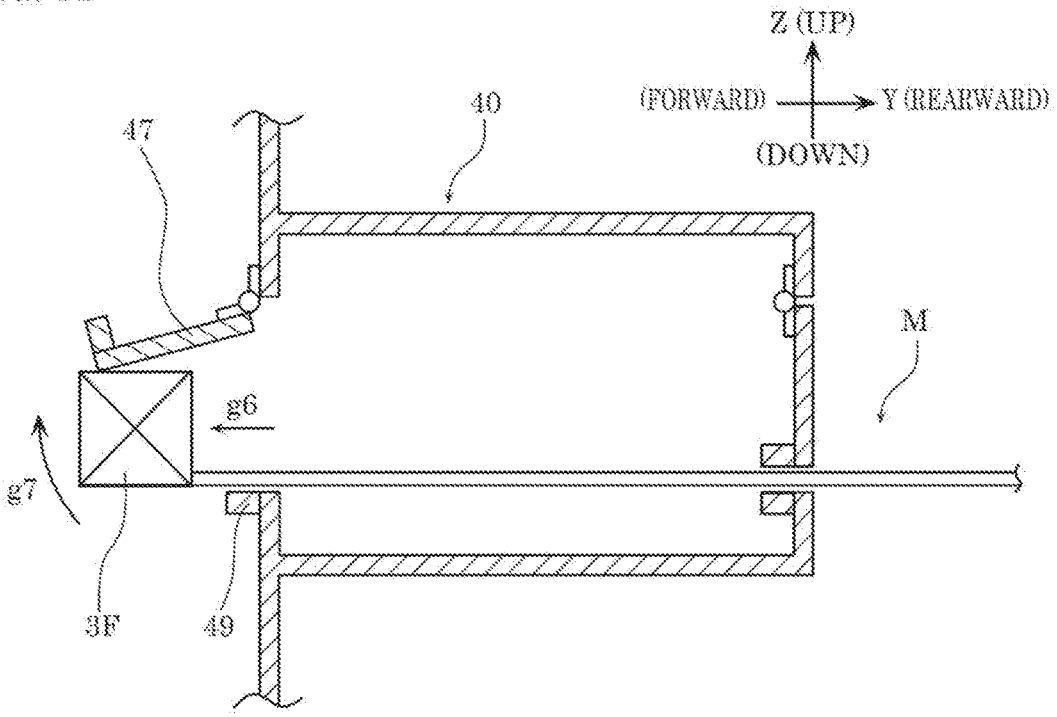
FIG. 8B is for illustrating a step of inserting a mask through an insertion opening into a screen printing apparatus according to one embodiment of the present disclosure.

In FIG. 8A, an operator moves mask M farther forward (arrow g4) such that front frame component 3F passes the first detecting unit (first shutter 43) and first shutter 43 closes (arrow g5). As a result, first sensor 45 detects a closed first shutter 43. In FIG. 8B, an operator moves mask M farther forward (arrow g6) whereby second shutter 47 is lifted upward and forward (arrow g7) by the front surface of front frame component 3F of mask M. As a result, second sensor 49 detects an open second shutter 47.

Figure 9A:
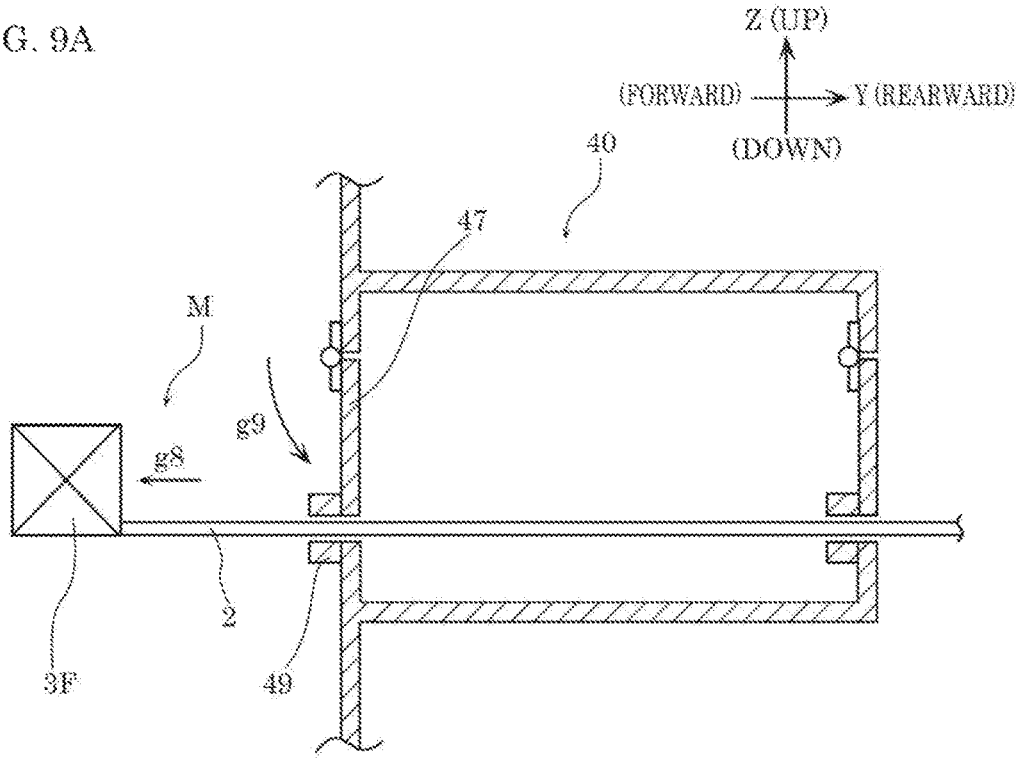
FIG. 9A is for illustrating a step of inserting a mask through an insertion opening into a screen printing apparatus according to one embodiment of the present disclosure.
Figure 9B:
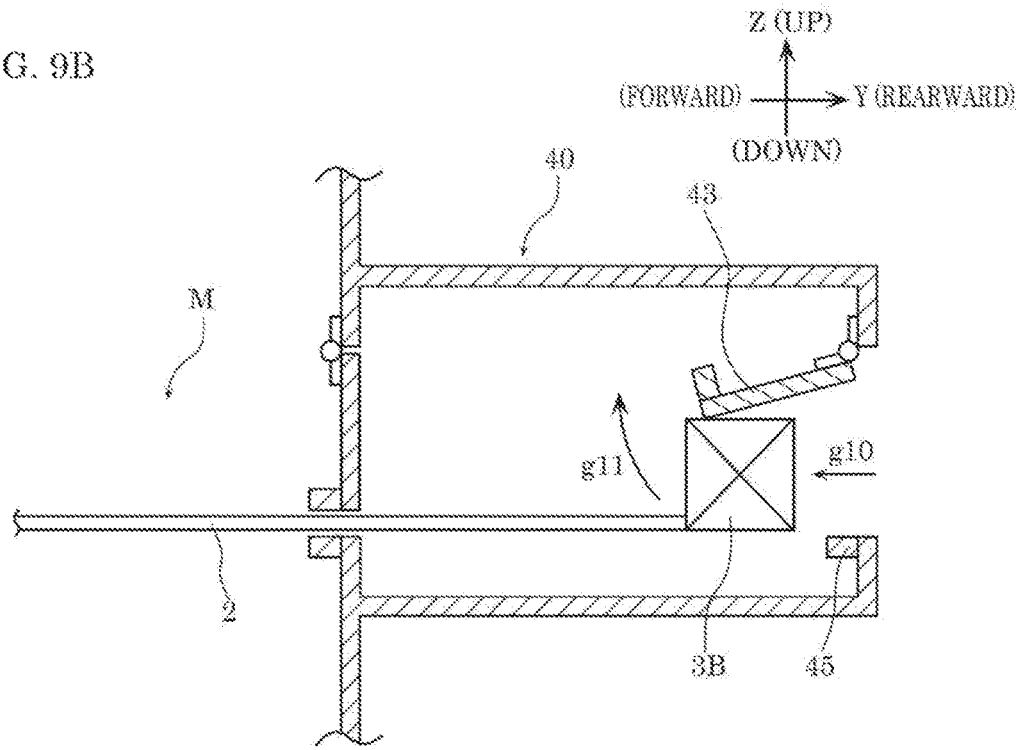
FIG. 9B is for illustrating a step of inserting a mask through an insertion opening into a screen printing apparatus according to one embodiment of the present disclosure.

In FIG. 9A, an operator moves mask M farther forward (arrow g8) such that front frame component 3F passes the second detecting unit (second shutter 47) and second shutter 47 closes (arrow g9). As a result, second sensor 49 detects a closed second shutter 47. In FIG. 9B, an operator moves mask M farther forward (arrow g10) whereby first shutter 43 is lifted upward and forward (arrow g11) by the front surface of back frame component 3B of mask M. As a result, first sensor 45 detects an open first shutter 43.

When an operator moves mask M farther forward and back frame component 3B passes the first detecting unit (first shutter 43), first sensor 45 detects a closed state. When an operator moves mask M farther forward and back frame component 3B passes the second detecting unit (second shutter 47), second sensor 49 detects an open state. When an operator moves mask M farther forward and back frame component 3B passes the second detecting unit (second shutter 47), second sensor 49 detects a closed state.

In the above described mask insertion steps, when there is change in states from both the first detecting unit (first shutter 43 and first sensor 45) and the second detecting unit (second shutter 47 and second sensor 49) detecting closed states (see FIG. 7A) to only the first detecting unit detecting an open state (see FIG. 7B; second detecting unit is detecting a closed state), print suspension controller 62 determines that some object has been inserted through insertion opening 41. Subsequently, when there is a change in states from the first detecting unit detecting a closed state (see FIG. 8A; second detecting unit is detecting a closed state) to only the second detecting unit detecting an open state (see FIG. 8B; first detecting unit is detecting a closed state), print suspension controller 62 determines that the inserted object is mask M. In this case, print suspension controller 62 does not suspend but rather continues the printing.

In this way, when mask M is inserted through insertion opening 41, even if front frame component 3F moves inward and reaches the first detecting unit (i.e., the first detection position) or the second detecting unit (i.e., the second detection position), the first detecting unit and the second detecting unit will not simultaneously detect open states. Similarly, even if back frame component 3B moves inward and reaches the first detecting unit (i.e., the first detection position) or the second detecting unit (i.e., the second detection position), the first detecting unit and the second detecting unit will not simultaneously detect open states.

Figure 10:
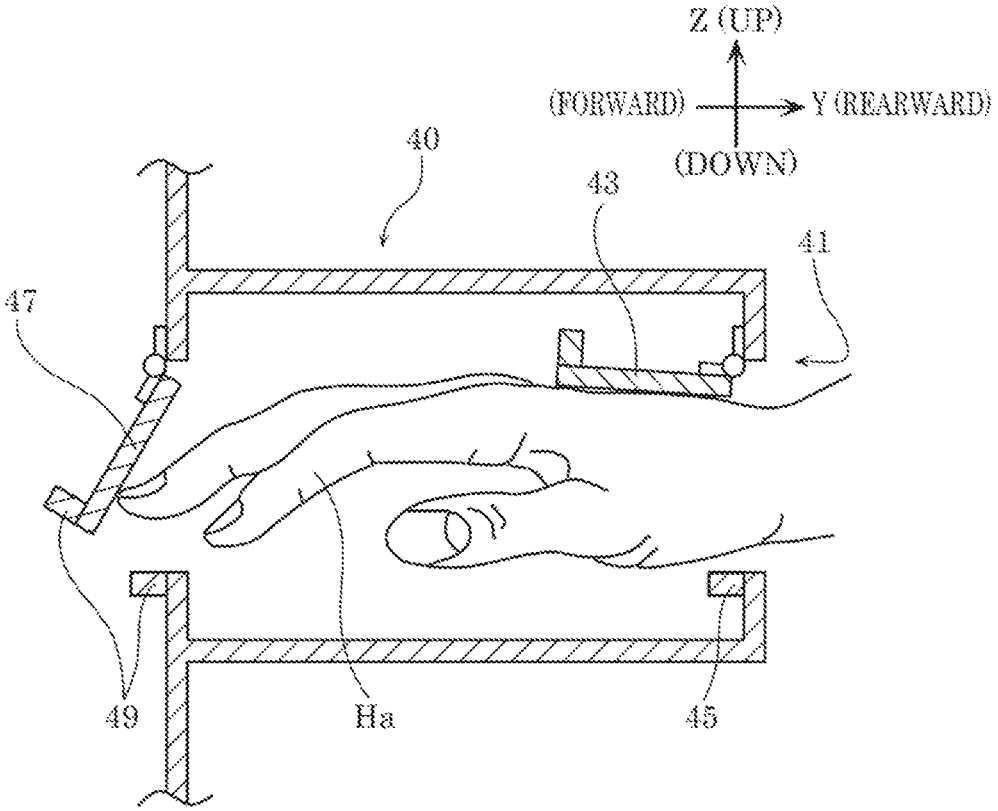
FIG. 10 is for illustrating detection of insertion of a foreign object by an insertion detector included in a screen printing apparatus according to one embodiment of the present disclosure.

Next, a state in which an operator has inserted his or her hand Ha through insertion opening 41 of insertion detector 40 will be described with reference to FIG. 10. When an operator inserts his or her hand Ha through insertion opening 41, first shutter 43 opens whereby first sensor 45 detects an open first shutter 43. When hand Ha is moved farther inward and second shutter 47 is opened with the tip of a finger while first shutter 43 is open, second sensor 49 detects an open second shutter 47.

When the second detecting unit (second shutter 47 and second sensor 49) detects an insertion (open state; presence) while the first detecting unit (first shutter 43 and first sensor 45) is detecting insertion (open state; presence), print suspension controller 62 determines that a foreign object—which is an object other than mask M, such as hand Ha of an operator—has been inserted into the apparatus through insertion opening 41. In this case, print suspension controller 62 suspends the printing.

Next, conditions regarding distance D in insertion detector 40 between the first detecting unit (first shutter 43) and the second detecting unit (second shutter 47) which is necessary for preventing a replacement mask M inserted through insertion opening 41 from being erroneously detected as a foreign object other than mask M will be discussed with reference to FIG. 11A and FIG. 11B. Here, in order to provide comparative examples to Embodiment 1, in FIG. 11A, insertion detector 140 and insertion opening 141 are exemplified as corresponding to insertion detector 40 and insertion opening 41, respectively, and in FIG. 11B, insertion detector 40 and insertion opening 41 are exemplified as corresponding to insertion detector 240 and insertion opening 241, respectively.

Figure 11A:
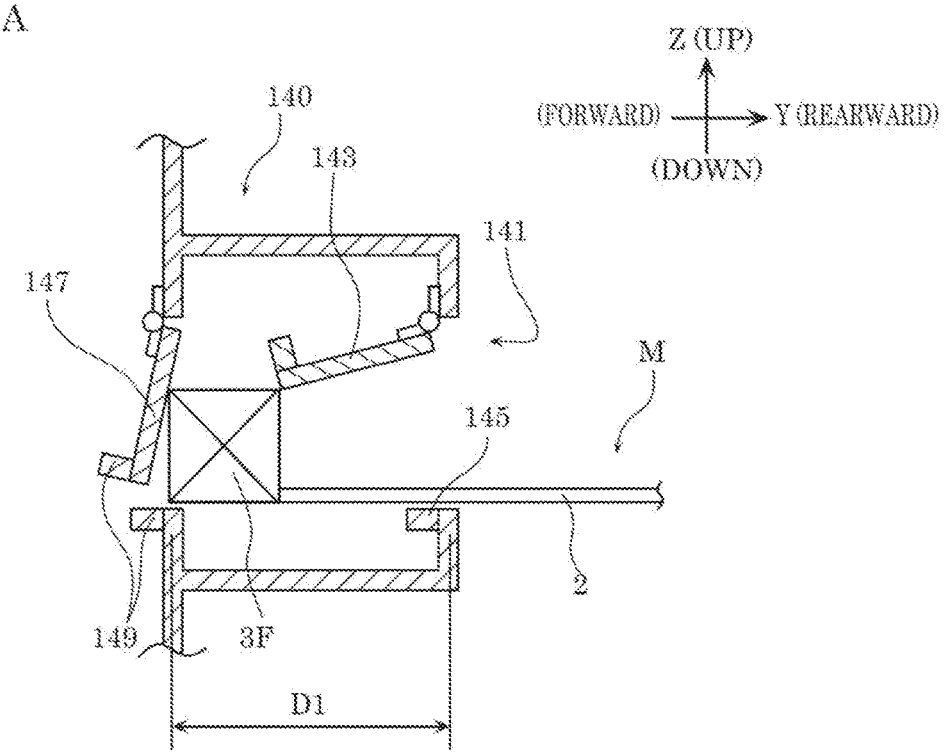
FIG. 11A is for illustrating components of an insertion detector included in a screen printing apparatus according to one embodiment of the present disclosure.

FIG. 11A illustrates an example in which inserted front frame component 3F is simultaneously detected as present by the first detecting unit and the second detecting unit due to distance D1 being too short, whereby the insertion of mask M is erroneously determined to be an insertion of a foreign object. In order to avoid such an erroneous determination, distance D between the first detecting unit (first shutter 143) and the second detecting unit (second shutter 147) needs to be set so as to prevent the front component of frame 3 (front frame component 3F) or the back component of frame 3 (back frame component 3B) of mask M located between the first detecting unit and the second detecting unit from being simultaneously detected by the first detecting unit (first sensor 145) and the second detecting unit (second sensor 149).

Figure 11B:
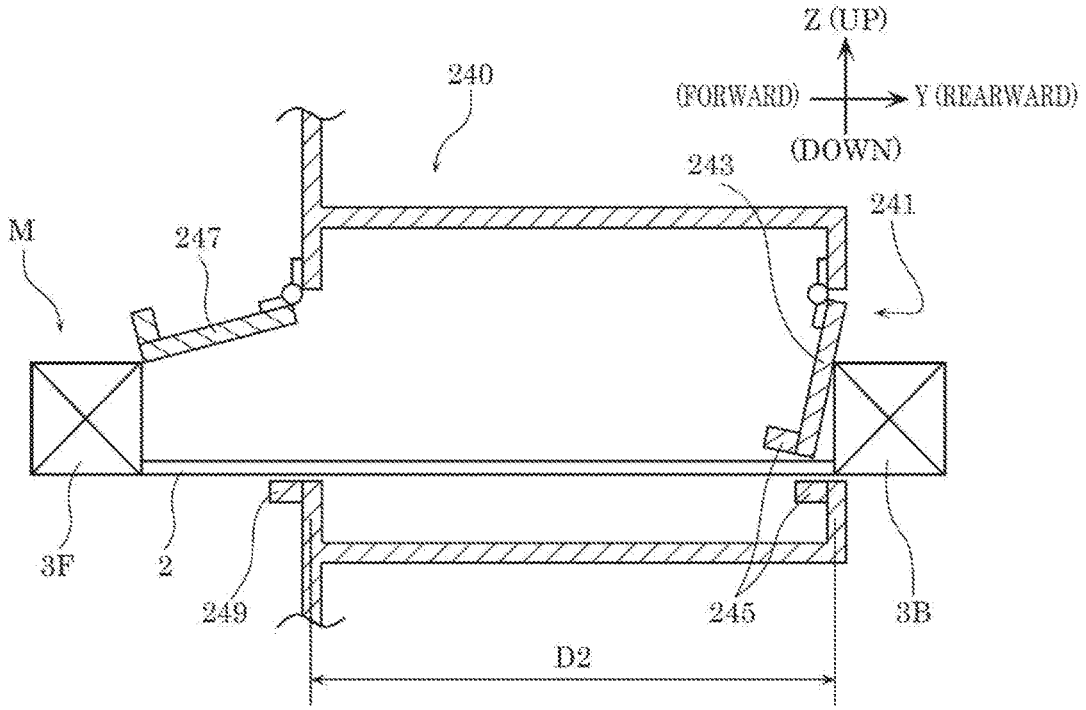
FIG. 11B is for illustrating components of an insertion detector included in a screen printing apparatus according to one embodiment of the present disclosure.

FIG. 11B illustrates an example in which distance D2 is set such that back frame component 3B reaches the first detecting unit while the second detecting unit is detecting front frame component 3F. In this case, since the first detecting unit and the second detecting unit simultaneously detect open states, the insertion of mask M is erroneously detected as insertion of a foreign object. In order to avoid such an erroneous determination, distance D between the first detecting unit (first shutter 243) and the second detecting unit (second shutter 247) needs to be set so as to prevent the front component of frame 3 (front frame component 3F) and the back component of frame 3 (back frame component 3B) of mask M located between the first detecting unit and the second detecting unit from being simultaneously detected by the first detecting unit (first sensor 245) and the second detecting unit (second sensor 249).

Figure 12:
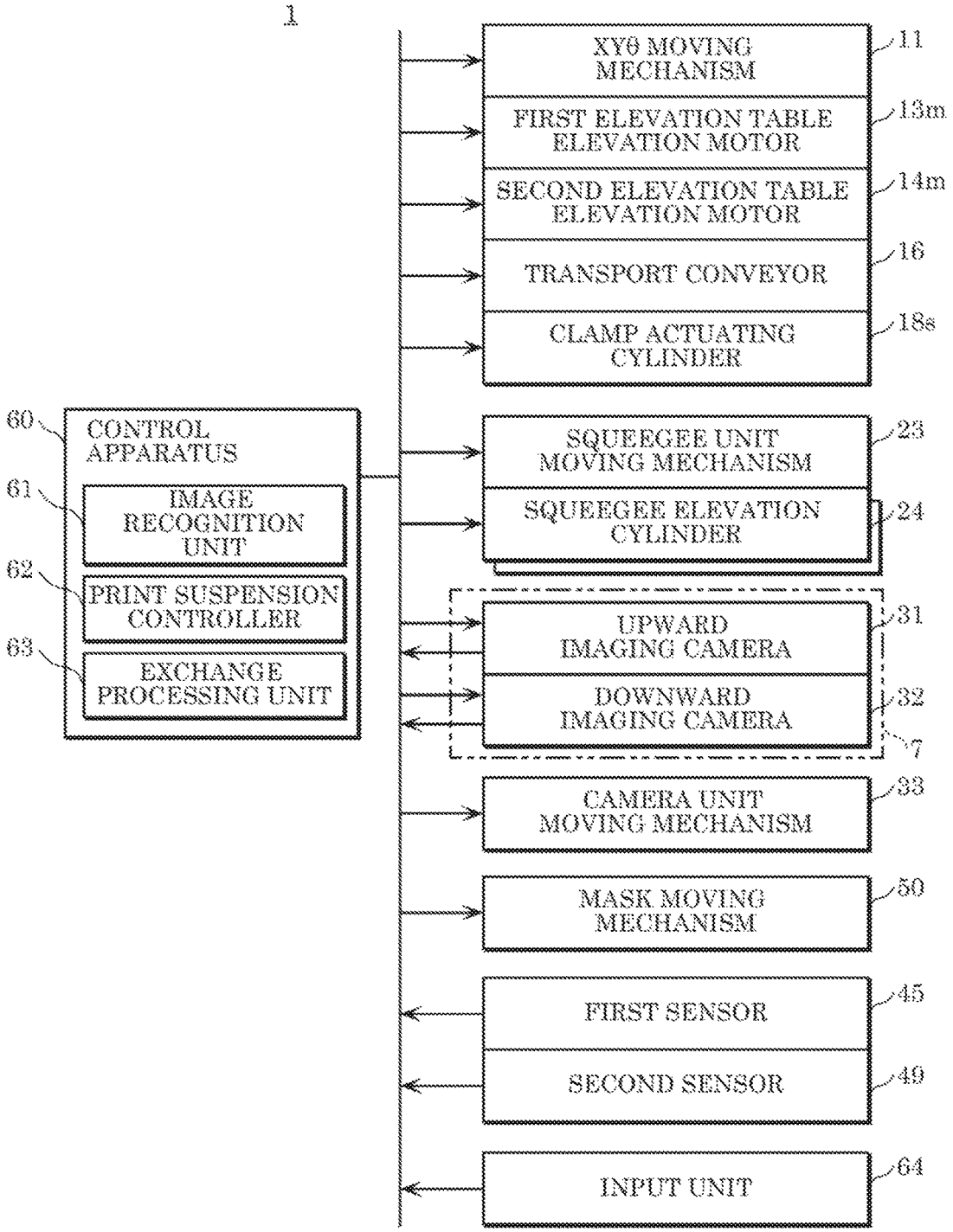
FIG. 12 is a block diagram illustrating a control system of a screen printing apparatus according to one embodiment of the present disclosure.

Next, the control system in screen printing apparatus 1 will be described with reference to FIG. 12. Screen printing apparatus 1 includes control apparatus 60. Control apparatus 60 controls the transporting of substrate 4 along the X line by transport conveyers 16 included in substrate retaining and moving unit 5 and the raising and lowering of lower support component 17 by second elevation table elevation motor 14*m*. Control apparatus 60 additionally controls the clamping of substrates via clamp 18 by clamp actuating cylinder 18*s*, the moving of substrate 4 in a horizontal plane by XYθ moving mechanism 11, and the raising and lowering of first elevation table 13 by first elevation table elevation motor 13*m*.

Control apparatus 60 additionally controls the moving of squeegee unit 6 along the Y line by squeegee unit moving mechanism 23 and the raising and lowering of squeegees 22 by squeegee elevation cylinder 24. Control apparatus 60 additionally controls the moving of camera unit 7 in a horizontal plane by camera unit moving mechanism 33, the imaging by upward imaging camera 31 and downward imaging camera 32 included in camera unit 7.

Control apparatus 60 includes, as internal processing units, image recognition unit 61, print suspension controller 62, and exchange processing unit 63. Image recognition unit 61 performs image recognition on image data obtained by imaging by upward imaging camera 31 and downward imaging camera 32 and input into control apparatus 60. Print suspension controller 62 monitors detection signals indicating open and closed states from first sensor 45 and second sensor 49, and monitors the insertion of mask M or a foreign object other than mask M through insertion opening 41. When first sensor 45 and second sensor 49 simultaneously detect open states, print suspension controller 62 determines that a foreign object has been inserted and suspends printing.

In other words, print suspension controller 62 performs monitoring including determining whether something has been inserted through insertion opening 41 from the detection results from first sensor 45 and second sensor 49, and when print suspension controller 62 determines that something has been inserted, determining whether that thing is mask M or a foreign object that is not mask M. Print suspension controller 62 suspends printing when print suspension controller 62 detects an insertion of a foreign object—that is to say, when the second detecting unit (second shutter 47 and second sensor 49) detects an insertion while the first detecting unit (first shutter 43 and first sensor 45) is detecting an insertion.

Figure 13:
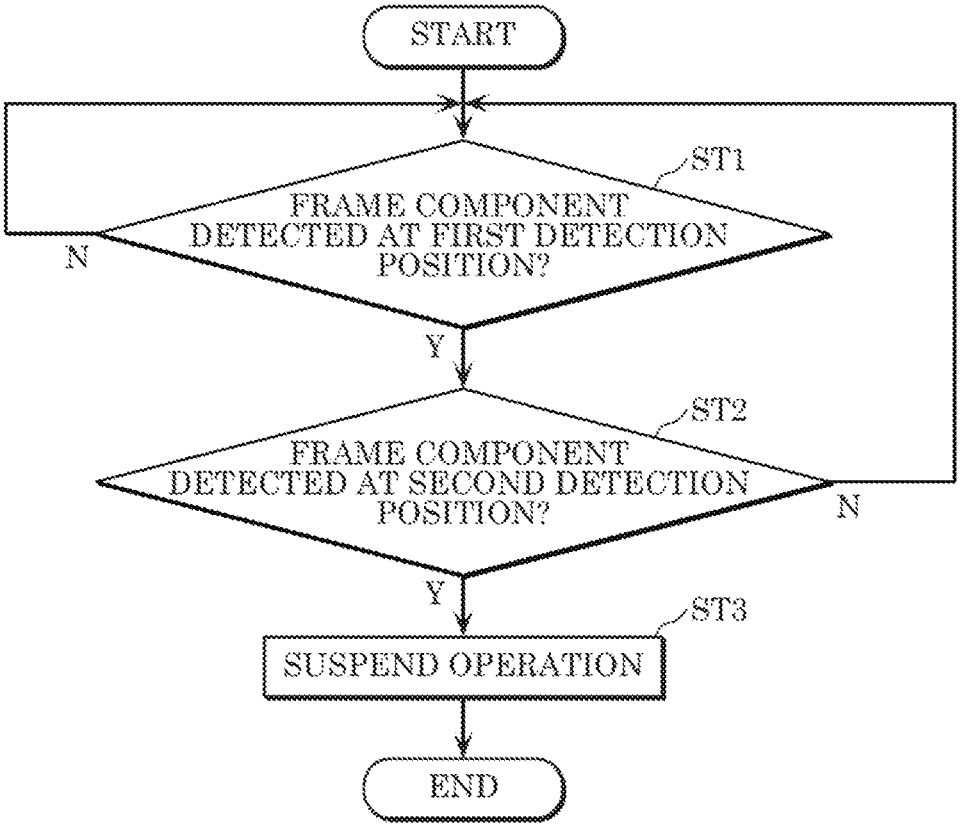
FIG. 13 is a flow chart illustrating a sequence of control steps performed when an object is inserted through an insertion opening into a screen printing apparatus according to one embodiment of the present disclosure.

Next, a sequence of control steps performed by print suspension controller 62 when mask M or a foreign object is inserted through insertion opening 41 will be described with reference to the flow chart illustrated in FIG. 13. Print suspension controller 62 performs the detection of the presence or absence of front frame component 3F or back frame component 3B of mask M at first detection position positioned at insertion opening 41 (first detection step; step ST1). Note that the first detection position is not limited to the position of insertion opening 41. For example, in addition to the position of insertion opening 41, the first detection position may be a position on the path between insertion opening 41 and printing position Pp along which mask M moves, and may be a position located closer to insertion opening 41 than the second detection position is (i.e., farther from printing position Pp). Print suspension controller 62 then performs the detection of the presence or absence of the front frame component (3F) or the back frame component (3B) of mask M at the second detection position which is farther from insertion opening 41 than the first detection position is (i.e., is closer to printing position Pp) (second detection step; step ST2). Print suspension controller 62 suspends printing when a detection result is presence in the second detection step while a detection result is presence in the first detection step (step ST3).

Exchange processing unit 63 performs the exchanging of masks M by causing mask moving mechanism 50 to move used mask M positioned at printing position Pp to exit position Pe, and move replacement mask M on standby at waiting position Pw to printing position Pp. A predetermined input related to the screen printing process performed by screen printing apparatus 1 is made on input unit 64 that connects to control apparatus 60.

In this way, printing position Pp at which mask M is retained and paste is printed onto substrate 4, and waiting position Pw which is behind printing position Pp and is a position at which a replacement mask M is kept on standby are set in screen printing apparatus 1, and mask M on standby at waiting position Pw is automatically moved to printing position Pp. Screen printing apparatus 1 includes a first detecting unit that is provided at insertion opening 41 through which mask M is inserted and detects the front component of frame 3 (front frame component 3F) of mask M inserted through insertion opening 41, and a second detecting unit that is provided in front of the first detecting unit and detects the front component of frame 3 of mask M inserted through insertion opening 41 and pushed inside. When the second detecting unit detects an insertion while the first detecting unit is detecting an insertion, screen printing apparatus 1 suspends printing.

This makes it possible to automatically exchange masks M without having to call an operator upon making a set-up change, which improves productivity. The safety of an operator can also be secured by automatically suspending printing when, for example, hand Ha of an operator is accidentally inserted through insertion opening 41 for inserting replacement masks M into screen printing apparatus 1. In other words, masks M can be productively and safely exchanged.

Although only some exemplary embodiments of the present disclosure have been described in detail above, those skilled in the art will readily appreciate that many modifications are possible in the exemplary embodiments without materially departing from the novel teachings and advantages of the present disclosure. Accordingly, all such modifications are intended to be included within the scope of the present disclosure.

INDUSTRIAL APPLICABILITY

A screen printing apparatus according to one embodiment of the present disclosure is effective in that masks can be productively and safely exchanged, and is applicable in fields in which components are mounted on substrates.

What is claimed is:

1. A screen printing apparatus that moves a mask, inserted through an insertion opening, to a printing position at which paste is printed onto a substrate via a mask moving mechanism, the screen printing apparatus comprising:

a first detecting unit configured to detect presence or absence of a front frame component of the mask and a back frame component of the mask at a first detection position on a path along which the mask inserted through the insertion opening is moved to the printing position;

a second detecting unit configured to detect presence or absence of the front frame component and the back frame component of the mask at a second detection position closer to the printing position than the first detection position is; and a print suspension controller that suspends printing when a detection result of the second detecting unit is presence while a detection result of the first detecting unit is presence.

2. The screen printing apparatus according to claim 1, wherein the first detecting unit includes:

a first shutter that opens forward when the mask is inserted and one of the front frame component and the back frame component of the mask presses against the first shutter and closes after one of the front frame component and the back frame component of the mask passes the first shutter; and a first sensor that detects whether the first shutter is open or closed, and the second detecting unit includes:

a second shutter that opens forward when the mask is inserted and one of the front frame component and the back frame component of the mask presses against the second shutter and closes after one of the front frame component and the back frame component of the mask passes the second shutter; and a second sensor that detects whether the second shutter is open or closed.

3. The screen printing apparatus according to claim 2, wherein when the mask is inserted, the first shutter and the second shutter do not interfere with a left frame component of the mask, a right frame component of the mask, or a screen of the mask.

4. The screen printing apparatus according to claim 2, wherein the first detecting unit further includes a first rear stop that inhibits the first shutter from swinging rearward, and the second detecting unit further includes a second rear stop that inhibits the second shutter from swinging rearward.

5. The screen printing apparatus according to claim 1, wherein between the first detecting unit and the second detecting unit is a space having a size and a shape that prevent the first detecting unit and the second detecting unit from simultaneously detecting one of the front frame component and the back frame component of the mask when the one of the front frame component and the back frame component of the mask is between the first detecting unit and the second detecting unit.

6. The screen printing apparatus according to claim 1, wherein the first detecting unit and the second detecting unit are spaced apart by a distance that prevents the first detecting unit and the second detecting unit from simultaneously detecting the front frame component and the back frame component of the mask when the front frame component and the back frame component of the mask are between the first detecting unit and the second detecting unit.

7. A screen printing method of moving a mask, inserted through an insertion opening, to a printing position at which paste is printed onto a substrate via a mask moving mechanism, the method comprising:

providing a first detecting unit, a second detecting unit and a print suspension controller:

a first detection step using the first detecting unit to detect presence or absence of a front frame component of the mask and a back frame component of the mask at a first detection position on a path along which the mask inserted through the insertion opening is moved to the printing position;

a second detection step using the second detecting unit to detect presence or absence of the front frame component and the back frame component of the mask at a second detection position closer to the printing position than the first detection position is; and a print suspension control step using the print suspension controller to suspend printing when a detection result is presence in the second detection step while a detection result is presence in the first detection step.

* * * * *